United States Patent [19]

Komamura

[11] Patent Number: 4,948,698

[45] Date of Patent: Aug. 14, 1990

[54] HEAT-PROCESSIBLE COLOR PHOTOGRAPHIC MATERIAL

[75] Inventor: Tawara Komamura, Hino, Japan

[73] Assignee: Konica Corporation, Tokyo, Japan

[21] Appl. No.: 418,660

[22] Filed: Oct. 10, 1989

[30] Foreign Application Priority Data

Oct. 13, 1988 [JP] Japan ..... 63-257998

[51] Int. Cl.[5] ..... G03C 5/54; G03C 1/40

[52] U.S. Cl. ..... 430/203; 430/226; 430/359; 430/378; 430/543; 430/548; 430/559

[58] Field of Search ..... 430/203, 226, 559, 548, 430/359, 378, 543

[56] References Cited

U.S. PATENT DOCUMENTS

| | | | |
|---|---|---|---|
| 4,420,556 | 12/1983 | Booms et al. | 430/549 |
| 4,483,914 | 11/1984 | Naito et al. | 430/203 |
| 4,585,731 | 4/1986 | Kobayashi et al. | 430/543 |
| 4,724,198 | 2/1988 | Yamada et al. | 430/506 |
| 4,837,141 | 6/1989 | Kohno et al. | 430/559 |

*Primary Examiner*—Paul R. Michl

*Assistant Examiner*—Janis L. Dote

*Attorney, Agent, or Firm*—Jordan B. Bierman

[57] ABSTRACT

A heat-processible color photographic material having on a base support at least a light-sensitive silver halide, a reducing agent, a binder and a dye-providing material represented by the following general formula (1) in disclosed.

(1)

where A is a coupler site capable of dye formation by entering into a coupling reaction with the oxidized product of the reducing agent; L is a divalent linkage grop binding to A at the active point of the coupler site represented by A; B is a ballast group having a sufficient molecular size or shape to render the dye-providing material of the general formula (1) substantially immobile during thermal development; Dye is a dye site, n is 1, 2 or 3, part of the coupler site A optionally serving as part of the dye site Dye.

12 Claims, No Drawings

HEAT-PROCESSIBLE COLOR PHOTOGRAPHIC MATERIAL

BACKGROUND OF THE INVENTION

The present invention relates to a heat-processible color photographic material, in particular, a heat-processible color photographic material of diffusion transfer type which contains a novel dye providing-material.

Heat-processible photographic materials which provide image in a simple and quick way through development conducted by a thermal dry process have been known and these materials as well as methods for forming image thereon are described in the literature including JP-B-43-4921 (the term "JP-B" as used herein means an "examined Japanese patent publication"), JP-B-43-4921, "Shashin Kogaku no Kiso (Fundamentals of Photographic Engineering)", Part I, Silver Photography, pp. 553–555, Corona-sha, 1979, and Research Disclosure (RD-17029), pp. 9–15, June, 1978.

Heat-processible photographic materials are available In two types, one intended to produce black-and-white image and the other for producing color image, and active efforts are being made today to design heat-processible photographic materials of the first type which produce color image using a variety of dye-providing materials.

In actual applications, heat-processible color photographic materials work in various ways and those which produce color image by transferring the diffusible dye released or formed upon thermal development (this process is hereinafter referred to as a "transfer process") are advantageous in many respects including image stability and sharpness, as well as ease and rapidity with which photographic processing can be achieved. Heat-processible color photographic materials that depend on this transfer process and methods of forming image by this process are described in the specifications of many patents such as JP-A-59-12431 (the term "JP-A" as used herein means as "unexamined published Japanese patent application"), JP-A-59-159159, JP-A-59-181345, JP-A-59-229556, JP-A-60-2950, JP-A-61-52643, JP-A-61-61158, JP-A-61-61157, JP-A-59-180550, JP-A-61-132952, JP-A-61-139842, and U.S. Pat. Nos. 4,595,652, 4,590,154 and 4,584,267.

Image formation on these heat-processible photographic materials of transfer type involves the steps of silver development, color formation and transfer but the respective steps are incapable of achieving an efficiency of 100%. Thus, in order to produce image of high density, not only the silver content but also the amounts of additives such as reducing agent and dye-providing materials must be increased. This problem could be solved by improving the efficiency of individual steps involved in photographic processing but considerable difficulty is encountered in increasing the efficiency of each step to nearly 100%. Furthermore, this approach causes other problems such as increased fog.

The present invention has been accomplished in order to solve these problems of the prior art and eliminate the defects inherent in the conventional heat-processible color photographic materials of transfer type.

SUMMARY OF THE INVENTION

An object, therefore, of the present invention is to provide a heat-processible photographic material capable of forming a high-density, low-fog color image. This photographic material allows the silver content, the amount of reducing agent and the thicknesses of light-sensitive layers to be reduced in such a way that dye transfer ability and image sharpness can be improved without sacrificing the efficiency of dye formation.

The present inventors conducted intensive studies in order to attain that object and found as a result that it could be attained by a heat-processible color photographic material having on a base support at least a light-sensitive silver halide, a reducing agent, a binder and a dye-providing material represented by the following general formula (1):

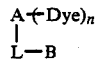

(1)

where A is a coupler site capable of dye formation by entering into a coupling reaction with the oxidized product of the reducing agent; L is a divalent linkage group binding to A at the active point of the coupler site represented by A; B is a ballast group having a sufficient molecular size or shape to render the dye-providing material of the general formula (1) substantially immobile during thermal development; Dye is a dye site; n is 1, 2 or 3. In a preferred embodiment, part of the coupler site represented by A may serve as part of the dye site represented by Dye.

DETAILED DESCRIPTION OF THE INVENTION

The dye-providing material represented by the general formula (1) which is to be contained in the heat-processible color photographic material of the present invention (said dye-providing material is hereunder sometimes referred to as the "dye-providing material of the present invention") is first described below in detail.

The coupler site denoted by A in the general formula (1) is preferably selected from among those represented by the following general formulas (2)–(11):

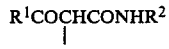

(2)

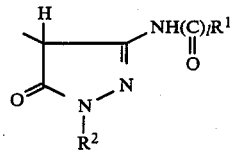

(3)

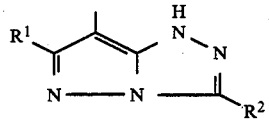

(4)

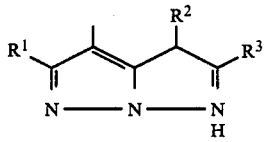

(5)

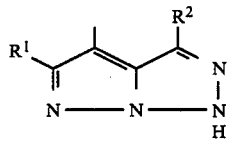

(6)

-continued (7)

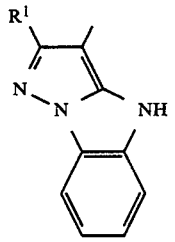

(8)

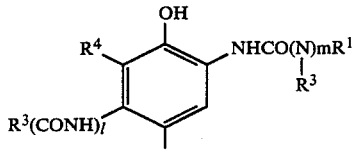

(9)

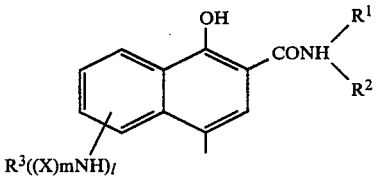

(10)

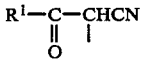

(11)

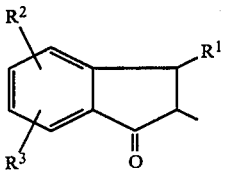

where $R^1$, $R^2$ and $R^3$ each represents an alkyl group (e.g. methyl, ethyl, n-propyl, i-propyl or t-butyl), an aryl group (e.g. phenyl) or a hydrogen atom, which alkyl or aryl group may have a substituent illustrated by, for example, an alkyl group, an aryl group, an alkyloxy group, a carboxyl group, a cyano group, a nitro group, an aryloxy group, an acyl group, an acyloxy group, a carbamoyl group, a sulfamoyl group, an acylamino group, an alkylsulfonylamino group, a sulfamoylamino group, an alkoxycarbamoyl group, a hydroxyl group or a halogen atom (e.g. F, Cl or Br), provided that at least one of $R^1$ and $R^2$ is substituted by the dye site (Dye) or serves as part of the dye site; l is 0 or 1; m is 0 or 1; and X is CO or $SO_2$.

The divalent linkage group represented by L in the general formula (1) may preferably be exemplified by the following groups:

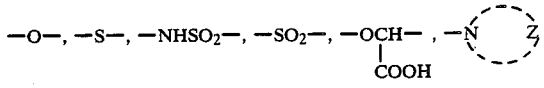

(Z is a collection of atoms that form the nitrogenous hetero ring and it preferably has a carbonyl group adjacent the binding site of the active point of the coupler site).

A ballast group represented by B in the general formula (1) is preferably an organic group having at least 8, preferably at least 12 but no more than 40 carbon atoms (which may have a substituent, in particular, a hydrophilic group such as $SO_3H$ or COOH) or a polymer residue, with the latter being particularly preferred.

When B is a polymeric residue, the dye-providing material represented by the general formula (1) is preferably a polymer derived from a monomer represented by the following general formula (12):

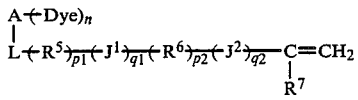

(12)

where A, L, n and Dye each has the same meaning as defined in the general formula (1); $R^5$ and $R^6$ are each a divalent hydrocarbon group (e.g. alkylene, arylene, aralkylene, alkylenearylene or arylenealkylene); $J^1$ and $J^2$ are each a divalent linkage group (e.g. —NHCO, —CONH—, —O—, —S—, —OCO—, —COO— or —$SO_2$—); $p_1$, $p_2$, $q_1$ and $q_2$ are each an integer of 0 or 1; and $R^7$ is a hydrogen atom or an alkyl group (e.g. methyl, ethyl or n-butyl).

Examples of the dye site represented by Dye include an azo dye, an azomethine dye, an anthraquinone dye, a naphthoquinone dye, a styryl dye, a nitro dye, a quinoline dye, a carbonyl dye and a phthalocyanine dye. These dye sites preferably have a molecular weight of not more than 600 in order to insure enhanced diffusibility.

The spectral absorption of these dyes may be temporarily shifted to a shorter wavelength in order to regenerate the desired image color afterward, i.e., during thermal development or transfer. With a view to producing image of increased light fastness, these dyes may be replaced by chelatable dyes of the type described in JP-A-59-48765 and JP-A-59-124337. Infrared dyes having a maximum absorption above 720 nm may also be used.

The dyes described above should normally have colors that are the same as those of the dyes produced by the couplers to which they are bonded but combinations of different colors may of course be used, as in the case of an infrared dye combined with a cyan coupler. If necessary, dyes may be bonded to colorless couplers.

The following are non-limiting examples of the dye-providing material of the present invention.

C-1
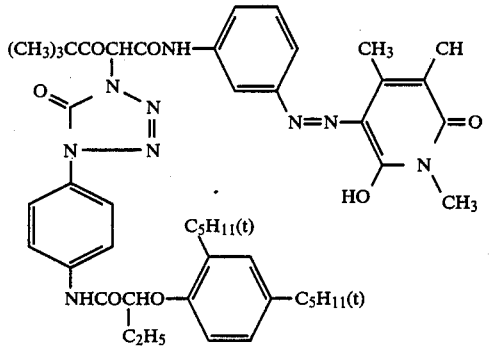
C-2
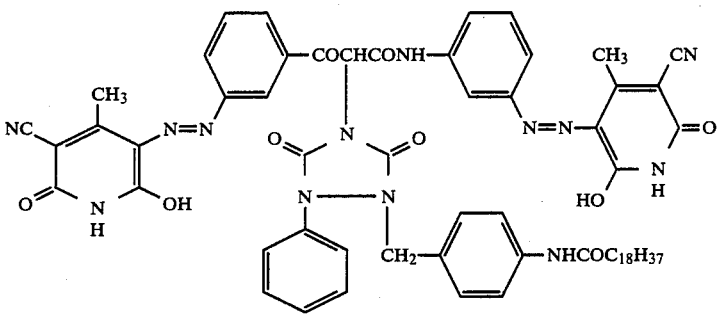
C-3
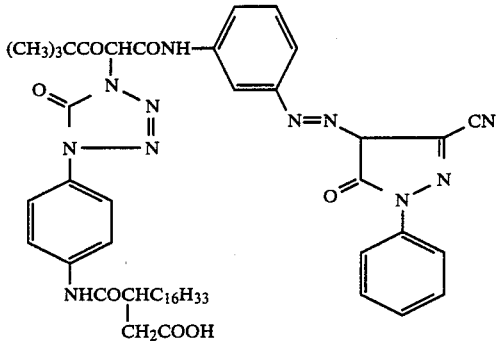
C-4
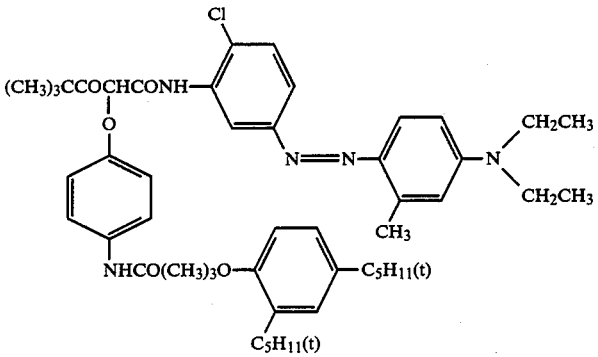

-continued
C-5
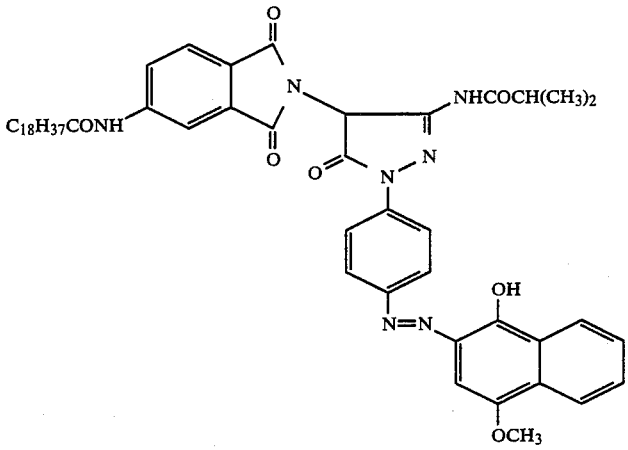
C-6
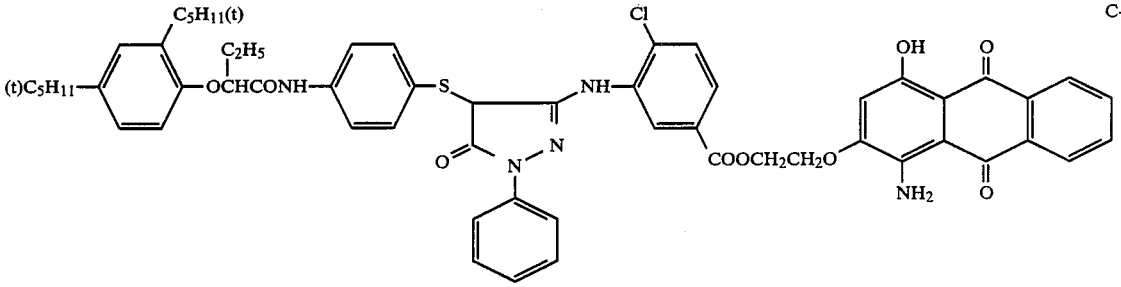
C-7
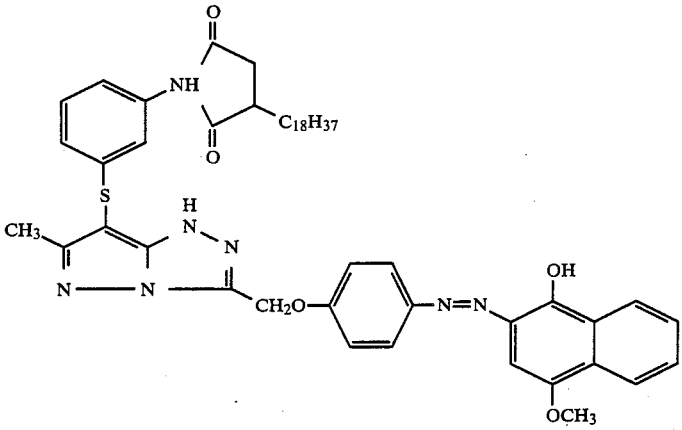
C-8
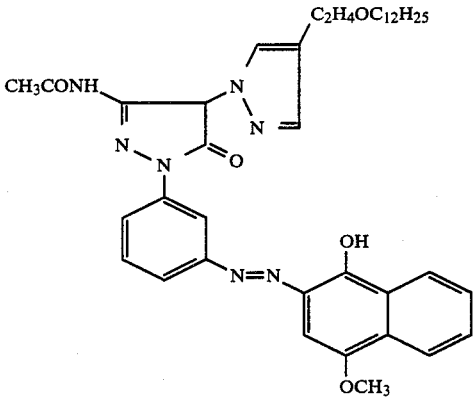

-continued
C-9
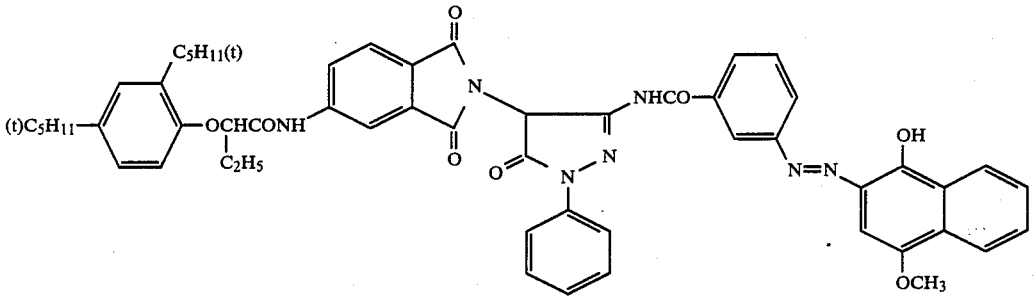
C-10
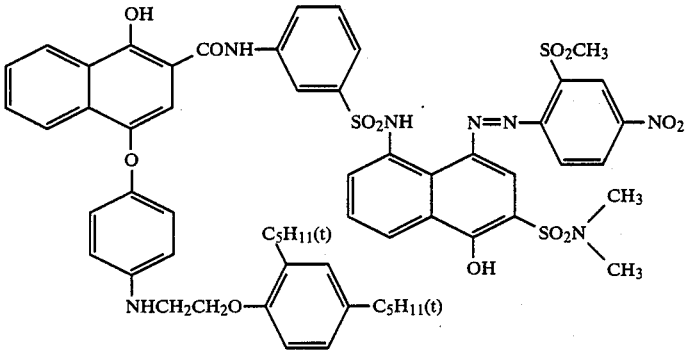
C-11
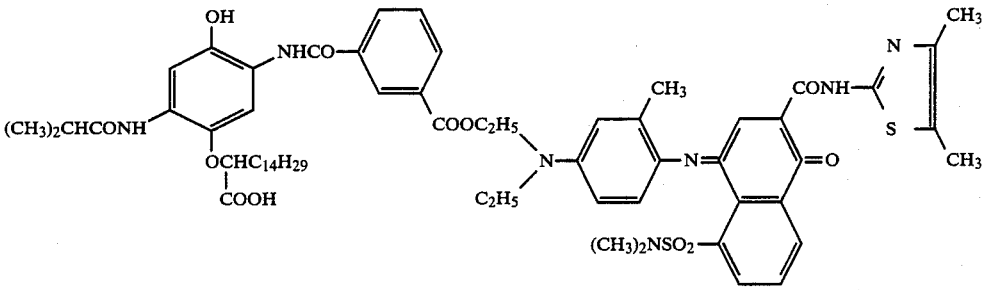
C-12
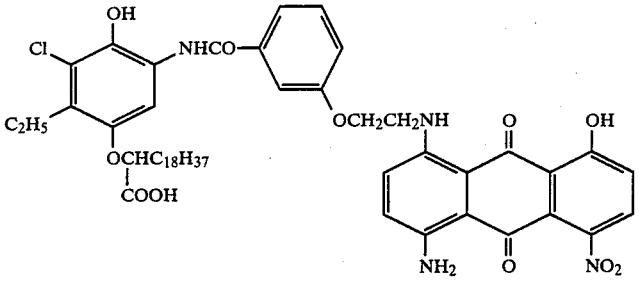
C-13
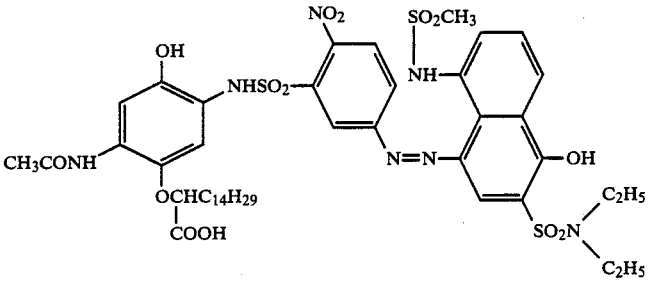

-continued
C-14
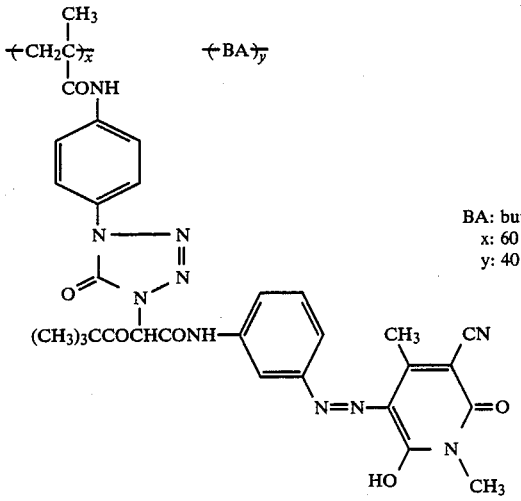
BA: butyl acrylate
x: 60 wt %
y: 40 wt %
C-15
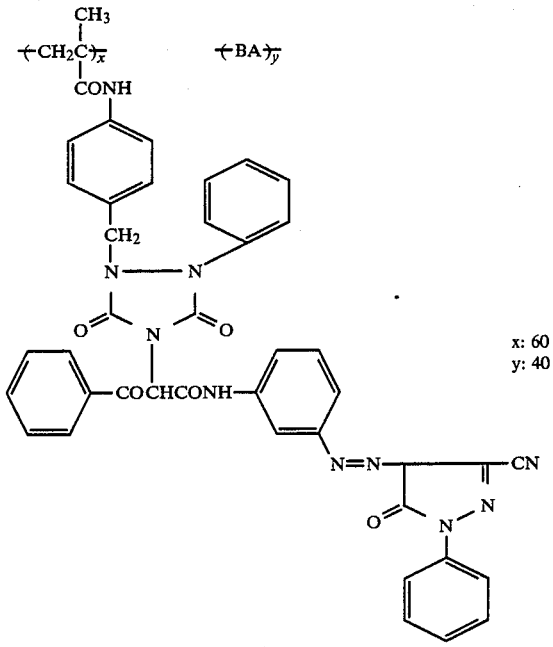
x: 60 wt %
y: 40 wt %
C-16
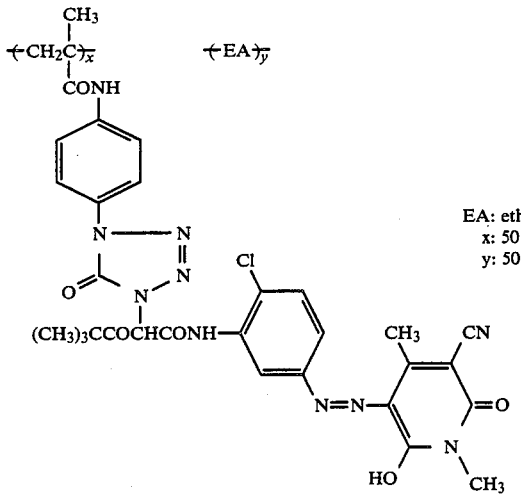
EA: ethyl acrylate
x: 50 wt %
y: 50 wt %

-continued
C-17
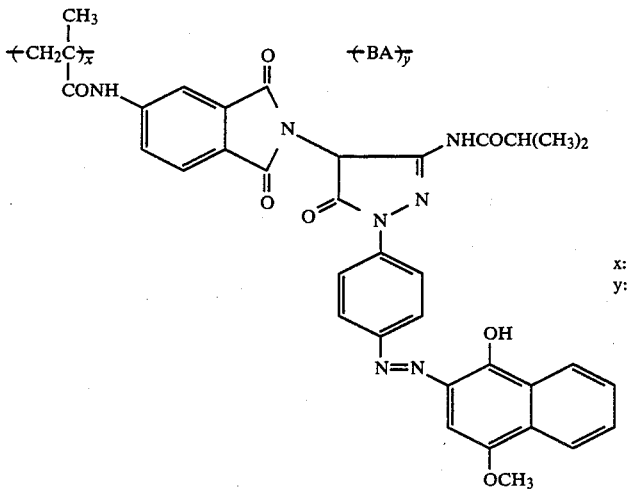
x: 50 wt %
y: 50 wt %
C-18
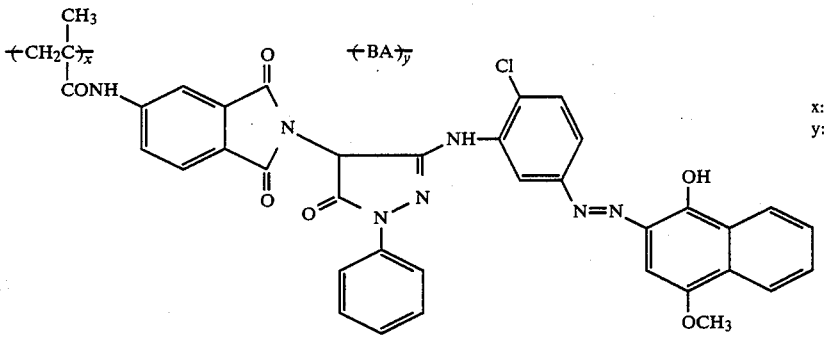
x: 60 wt %
y: 40 wt %
C-19
x: 50 wt %
y: 50 wt %
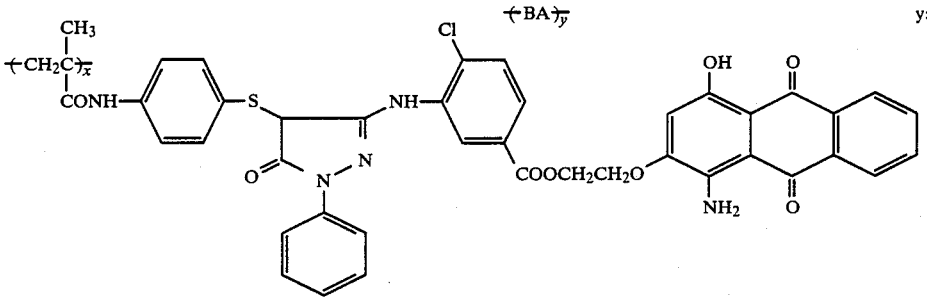
C-20
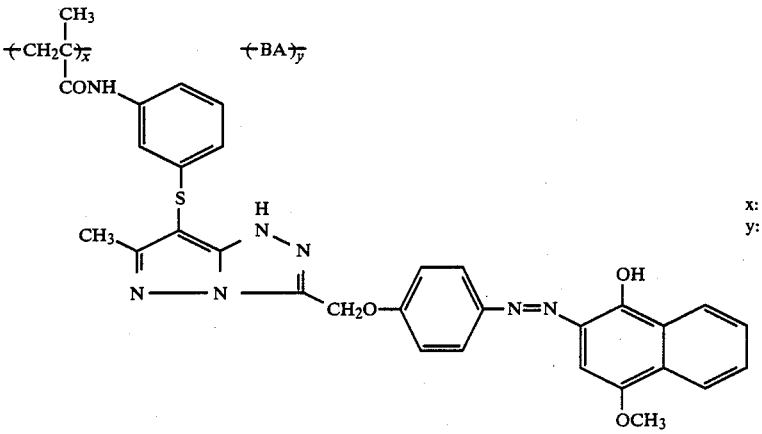
x: 70 wt %
y: 30 wt %

-continued
C-21
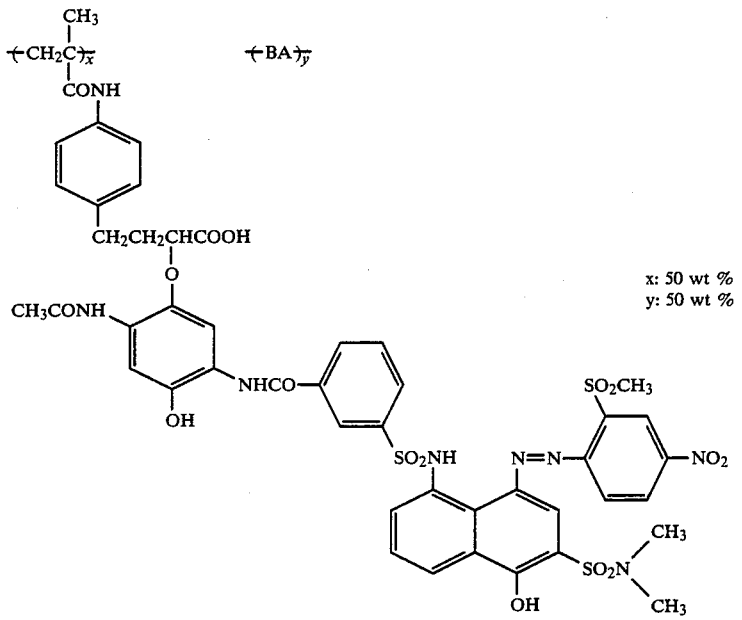
C-22
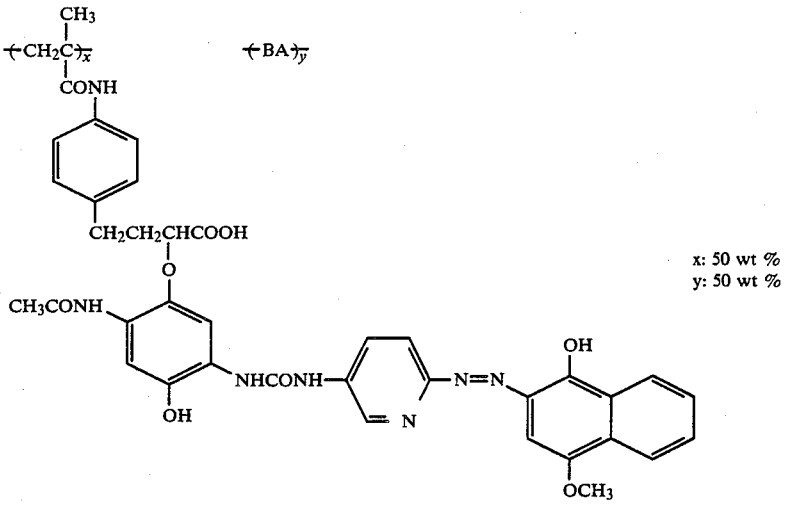

-continued

C-23

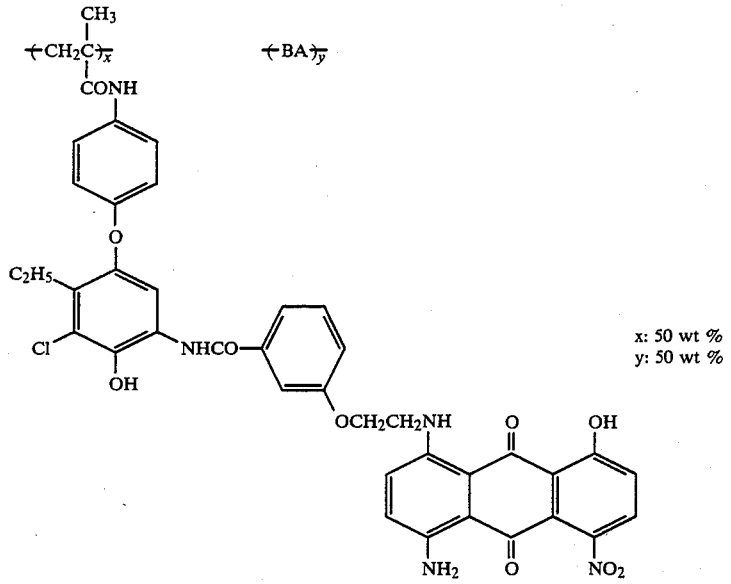

The dye-providing material of the present invention may be synthesized by either of the following two basic methods; A-L-B is first synthesized and then a separately prepared Dye is introduced into the synthesized A-L-B (Dye may be introduced into A to form A-Dye before L-B is introduced, or alternatively, Dye is introduced into A-L before B is introduced); or A-L or A-L-B having an anilino group (which is not present in L or B) is diazotized before it is subjected a coupling reaction with a suitable coupler (when the method starts with A-L, B is subsequently introduced).

Specific examples of the way to synthesize the dye-providing material of the present invention are described below.

Synthesis 1 (synthesis of C-1)

The route of synthesis of C-1 involves the following reactions:

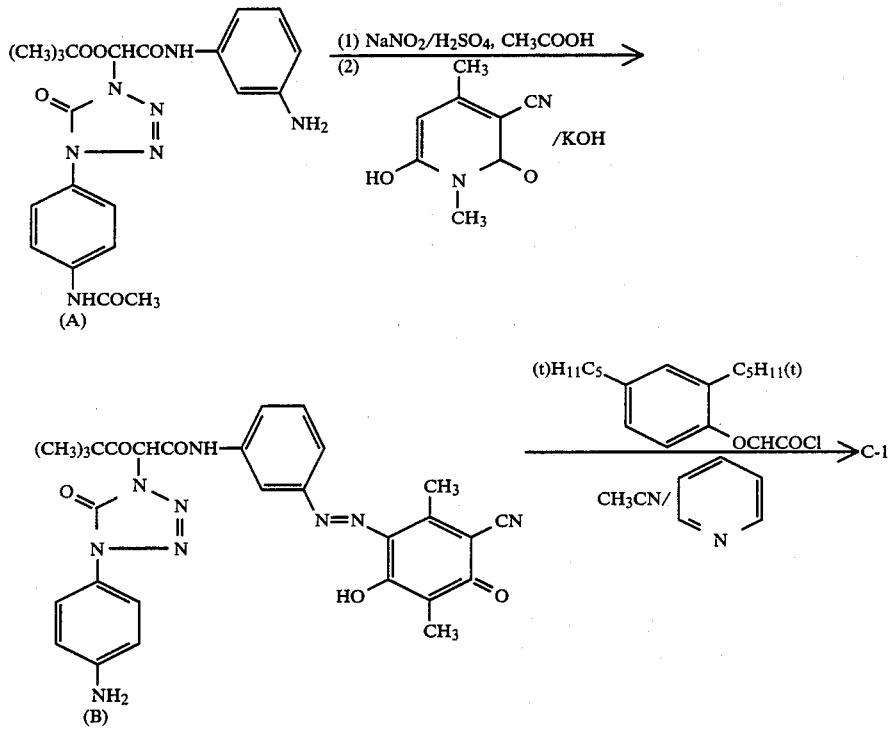

The specific procedure of synthesis is as follows.

Sodium sulfite (7.7 g) is slowly added to concentrated sulfuric acid (50 ml) at a temperature not higher than 10° C. and by stirring the mixture until the sodium sulfite dissolves completely, nitrosyl sulfate is obtained. To a solution of compound (A) (46.9 g) in acetic acid (300 ml), the entire portion of the nitrosyl sulfate in solution is added dropwise at a temperature not higher than 20° C., followed by stirring at room temperature for 30 min to obtain a diazo solution. In the next step, 1,4-di-methyl-3-cyano-6-hydroxy-2-pyridone (16.4 g) is added under stirring to an aqueous solution (800 ml) containing 10% potassium hydroxide while the entire portion of the diazo solution is added dropwise under cooling to a temperature not higher than 20° C. After the addition, sodium hydroxide (50 g) is added and the mixture is stirred at room temperature for 30 min. Thereafter, an additional 10 g of sodium hydroxide is added and the mixture is stirred at 50° C. for 30 min. The stirred mixture is neutralized with dilute sulfuric acid and the resulting solid matter is recovered by filtration and dried to obtain 42.1 g of the intermediate product (B).

A portion (23.4 g) or (B) is added to acetonitrile (200 ml) and pyridine (15 ml) under stirring, followed by dropwise addition of α-(2,4-di-tert-aminophenoxy) butyric acid (6.9 g). Thereafter, the mixture is heated under reflux for 2 h and the solid matter precipitating upon cooling is recovered by filtration and dried to obtain 20.7 g of the end product (C-1).

Synthesis 2 (synthesis of C-13)

A portion (11.7 g) of the intermediate product (B) obtained in Synthesis 1 is added to dimethylformamide (100 ml) and pyridine (8 ml), and methacrylic acid chloride (2.2 g) is added dropwise under stirring. Thereafter, the mixture is stirred at room temperature for 2 h and poured into water. The precipitating solid matter is recovered by filtration, washed with acetonitrile and dried to obtain 10.1 g of a monomer.

The monomer (9 g) and butyl acrylate (6 g) are dissolved in dimethylformamide (75 ml) and the solution is heated to 80° C. in a nitrogen stream. After adding azobisisobutyronitrile (0.3 g) as a polymerization initiator, reaction is effected at 80°–84° C. for 2 h. The same reaction is carried out at 80°–84° C. for 2 h after adding an additional 0.3 g of the initiator. The reaction solution is poured into pure water and the precipitating solid matter is recovered by filtration and dried to obtain 13.7 g of the end product (C-13).

In the practice of the present invention, the dye-providing materials of the present invention may be used either on their own or as admixtures. If desired, they may be used in combination with dye-providing materials of the type described in such patents as U.S. Pat. Nos. 4,631,251, 4,656,124, 4,650,748 and Japanese Patent Application No. 62-132751.

The amount of the dye-providing materials used is by no means limited and may be determined according to their type, the manner in which they are used (i.e., either singly or in combination) or the number of photographic constituent layers of which the heat-processible photographic material of the present invention is composed (i.e., a single layer or two or more layers in superposition). As a guide, the dye-providing materials may be used in an amount of 0.005–50 g, preferably 0.1–10 g, per square meter.

The dye-providing materials for use in the present invention may be incorporated in photographic constituent layers of the heat-processible photographic material by any suitable method. For instance, the dye-providing materials are dissolved in low-boiling solvents (e.g., methanol, ethanol and ethyl acetate) and/or high-boiling solvents (e.g., dibutyl phahlate, dioctyl phthalate and trioresyl phosphate) and uniform dispersions are made by treatment with ultrasonic waves. Alternatively, the dye-providing materials are dissolved in alkaline aqueous solutions (e.g., a 10% aqueous solution of sodium hydroxide) and neutralized with mineral acids (e.g., hydrochloric acid or nitric acid). In another method, the dye-providing materials are dispersed together with aqueous solutions of appropriate polymers (e.g., gelatin, polyvinylbutyral and polyvinylpyrrolidone) by means of a ball mill.

We now describe the light-sensitive silver halide to be used in the present invention. Any silver halides can be used and they include, for example, silver chloride, silver bromide, silver iodide, silver chlorobromide, silver chloroiodide and silver iodobromide. Such light-sensitive silver halides can be prepared by any of the methods commonly employed in the photographic art.

If desired, a silver halide emulsion having silver halide grains with a duplex structure (i.e., the halide composition of the grain surface differing from that of the interior) may be used and an example of such duplex grains is core/shell type silver halide grains. The shell of these grains may change in halide composition stepwise or gradually. The silver halide grains used may have a well-defined crystal habit as in cubes, spheres, octahedra, dodecahedra or tetradecahedra. Alternatively, they may not have any well-defined crystal habit. Suitable silver halides are shown in JP-A-60-215948.

A silver halide emulsion comprising tabular silver halide grains of the type described in JP-A-58-111933, JP-A-58-111934, JP-A-58-108526 and Research Disclosure No. 22534 may also be used; such grains have two parallel crystal planes each of which has a greater area than any other single crystal of these grains and the aspect ratio (i.e., diameter-to-thickness ratio) of these grains is at least 5:1.

The present invention also permits the use of a silver halide emulsion containing internal latent-image forming silver halide grains whose surface is not prefogged. Examples of such emulsions include: those which comprise silver halide grains having a higher sensitivity in their interior than on the surface, as shown in U.S. Pat. Nos. 2,592,250, 3,206,313, 3,317,322, 3,511,662, 3,447,927, 3,761,266, 3,703,584 and 3,736,140; those which comprise silver halide grains having polyvalent metal ions incorporated therein, as shown in U.S. Pat. Nos. 3,271,157, 3,447,927 and 3,531,291; those which comprise dopant-containing silver halide grains with their surface being chemically sensitized to a small extent, as shown in U.S. Pat. No. 3,761,276; those which comprise grains with a laminated structure, as shown in JP-A-50-8524 and JP-A-50-38525; and silver halide emulsions of the type described in JP-A-52-156614 and JP-A-55-127549.

The silver halide grains in these light-sensitive emulsions may be coarse or fine; preferred grain sizes are on the order of 0.005 μm to 1.5 μm in diameter, with the range of from about 0.01 to about 0.5 μm being more preferred.

According to another method for preparing light-sensitive silver halides, a light-sensitive silver salt forming component may be used in the presence of organic silver salts (to be described below) so as to form light-sensitive silver halides in part of the organic silver salts.

These light-sensitive silver halides and light-sensitive silver salt forming component may be used in combination in a variety of methods, and the amount used in one photographic layer preferably ranges from 0.001 to 50 g, more preferably 0.1–10 g, per square meter of base support.

The light-sensitive silver halide emulsions illustrated above may be chemically sensitized by any of the methods commonly employed in the photographic art.

The light-sensitive silver halide emulsions to be used in the present invention may be spectrally sensitized with known spectral sensitizers in order to provide sensitivity to the blue, green, red or near-infrared region.

Typical examples of the spectral sensitizers that can be used in the present invention include cyanine dyes, merocyanine dyes, complex (tri- or tetra-nuclear) cyanine dyes, holopolar cyanine dyes, styryl dyes, hemicyanine dyes and oxonole dyes.

These sensitizers are incorporated in amounts ranging from $1\times10^{-4}$ to 1 mole, preferably from $1\times10^{-4}$ to $1\times10^{-1}$ mole, per mole of the light-sensitive silver halide or silver halide forming component.

The sensitizers may be added at any stage of the preparation of silver halide emulsions; they may be added during the formation of silver halide grains, during the removal of soluble salts, before the start of chemical sensitization, during chemical sensitization or after completion of the chemical sensitization.

A variety of organic silver salts may optionally be employed in the heat-processible photographic material of the present invention in order to increase its sensitivity or improve its developability.

Illustrative organic silver salts that may be employed in the heat-processible photographic material of the present invention include: silver salts of long-chain aliphatic carboxylic acids and silver salts of carboxylic acids having a hetero ring, such as silver behenate and silver α-(1-phenyltetrazolethio) acetate (see JP-A-53-4921, JP-A-49-52626, JP-A-52-141222, JP-A-53-36224, JP-A-53-37626, JP-A-52-141222, JP-A-053-36224, JP-A-53-37610, U.S. Pat. Nos. 3,330,633, 3,794,496 and 4,105,451); and silver salts of an imino group as described in JP-B-44-26582, JP-B-45-12700, JP-B-45-18416, JP-B-45-22185, JP-A-52-137321, JP-A-58-118638, JP-A-58-118639, and U.S. Pat. No. 4,123,274.

Among the organic silver salts listed above, silver salts of an imino group are preferred. Particularly preferred are silver salts of benzotriazole derivatives such as 5-methylbenzotriazole or derivatives thereof, sulfobenzotriazole or derivatives thereof and N-alkylsulfamoylbenzotriazole or derivatives thereof.

These organic silver salts may be used either singly or as admixtures in the present invention. Silver salts prepared in suitable binders may be immediately used without being isolated. Alternatively, isolated silver salts may be dispersed in binders by suitable means before they are used. Methods of obtaining dispersions are illustrated by, but are in no way limited, to a ball mill, a sand mill, a colloid mill, a vibration mill, etc.

The organic silver salts are preferably used in amounts ranging from 0.01 to 500 moles, more preferably from 0.1 to 100 moles, most preferably from 0.3 to 30 moles, per mole of the light-sensitive silver halide.

The reducing agent for use in the heat-processible photographic material of the present invention (the term "reducing agent" as used herein shall include precursors of the reducing agent) may be selected from among those which are commonly employed in the field of heat-processible photographic materials.

Illustrative reducing agents that can be used in the present invention include: p-phenylenediamine-based or p-aminophenolic developing agents, phosphoroamidophenolic developing agents, sulfonamidoaniline-based developing agents, hydrazone-based color developing agents, and precursors of these developing agents, all being described in U.S. Pat. Nos. 3,531,286, 3,761,270, 3,764,328, Research Disclosure (RD) Nos. 12146, 15108, 15127, JP-A-56-27132, U.S. Pat. Nos. 3,342,599, 3,719,492, JP-A-53-135628 and JP-A-57-79035. Also usable are phenols, sulfonamidophenols, polyhydroxybenzenes, naphthols, hydroxybinaphthyls, methylenebisnaphthols, methylenebisphenols, ascorbic acids, 3-pyrazolidones, pyrazolones, etc.

The dye-providing materials may serve as reducing agents. A particularly preferred reducing agent is the N-(p-N,N-dialkyl)-phenylsulfamic acid salts described in JP-A-56-146133 and JP-A-62-727141.

The reducing agents may be used either on their own or as admixtures.

The amount in which the reducing agents are used in the heat-processible photographic material of the present invention depend upon many factors such as the type of light-sensitive silver halide used, the type of organic acid silver salt, and the type of other additives used. Usually, the reducing agents are used in amounts ranging from 0.01 to 1,500 moles per mole of light-sensitive silver halide, with the range of 0.1–200 moles being preferred.

Illustrative binders that can be employed in the heat-processible photographic material of the present invention include: synthetic high-molecular compounds such as polyvinylbutyral, polyvinyl acetate, ethyl cellulose, polymethyl methacrylate, cellulose acetate butyrate, polyvinyl alcohol and polyvinylpyrrolidone; synthetic or natural high-molecular compounds such as gelatin, gelatin derivatives (e.g., phthalated gelatin), cellulose derivatives, proteins, starches, and gum arabic. These high-molecular compounds may be used either singly or in combination. It is particularly preferred to employ gelatin or its derivatives in combination with synthetic hydrophilic polymers such as polyvinylpyrrolidone and polyvinyl alcohol. A more preferred binder is a mixture of gelatin and polyvinylpyrrolidone as disclosed JP-A-59-229556.

The binders are generally used in amounts ranging from 0.05 to 50 g, preferably from 0.2 to 20 g, per square meter of the base support.

The binders are preferably used in amounts of 0.1–10 g, more preferably 0.2–5 g, per gram of the dyeproviding material.

The heat-processible photographic material of the present invention is produced by forming photographic constituent layers on a base support. A variety of base supports can be used and they include: synthetic plastic films such as a polyethylene film, a cellulose acetate film, a polyethylene terephthalate film, and a polyvinyl chloride film; paper bases such as photographic raw paper, printing paper, baryta paper and resin-coated paper; and base prepared by coating these materials with electron-beam curable resin compositions, followed by curing of the same.

The heat-processible photographic material of the present invention is suitable for processing by transfer photography using an image-receiving member. In the practice of the present invention, a variety of thermal solvents are preferably incorporated in the heat-processible photographic material and or the image-receiving member. Thermal solvents are compounds capable of accelerating thermal development and/or heat transfer. Examples of such compounds are the polar organic compounds described in many references including U.S. Pat. Nos. 3,347,675, 3,6167,959, Research Disclosure (RD) No. 17643 (XII), JP-A-59-229556, JP-A-59-68730, JP-A-59-84236, JP-A-60-191251, JP-A-60-232547, JP-A-60-14241, JP-A-61-52643, JP-A-62-78554, JP-A-62-42153, JP-A-62-447377, U.S. Pat. Nos. 3,438,776, 3,666,477, 3,667,959, JP-A-51-19525, JP-A-53-24829, JP-A-53-60223, JP-A-58-118640, and JP-A-58-198038.

Particularly useful compounds are: urea derivatives (e.g., dimethylurea, diethylurea and phenylurea), amide derivatives (e.g., acetamide, benzamide and p-toluamide), sulfonamide derivatives (e.g., benzenesulfonamide and α-toluenesulfonamide), and polyhydric alcohols (e.g., 1,6hexanediol, 1,2-cyclohexanediol and pentaerythritol, and polyethylene glycol.

Water-insoluble solid thermal solvents may be used with particular advantage.

Specific examples of such water-insoluble thermal solvents are given in JP-A-62-136645, JP-A-62-139549, JP-A-63-53548, Japanese Patent Application Nos. 63-39950 and 63-54113.

Thermal solvents may be incorporated in various layers such as light-sensitive silver halide emulsion layers, intermediate layers, protective layers, and image-receiving layers in an image-receiving member so that the results desired in respective cases can be obtained.

Thermal solvents are usually incorporated in amounts ranging from 10 to 500 wt %, preferably from 30 to 200 wt %, of the binder.

The organic silver salts and thermal solvents may be dispersed in the same liquid dispersion system. The binder, dispersion medium and dispersing apparatus used in this case may be the same as those employed in preparing the respective liquid dispersions.

Besides the components described above, the heat-processible photographic material of the present invention may incorporate various other additives such as development accelerators, antifoggants, base precursors, etc.

Exemplary development accelerators include the compounds described in JP-A-59-177550, JP-A-59-111636 and JP-A-59-124333, the development accelerator releasing compounds described in JP-A-61-159642 and Japanese Patent Application No. 62-203908, and the metal ions having an electronegativity of 4 or higher which are described in Japanese Patent Application No. 63-104645.

Illustrative antifoggants include: the higher aliphatic acid described in U.S. Pat. No. 3,645,739; the mercuric salt described in JP-B-47-11113; the N-halogen compound described in JP-A-51-47419; the mercapto compound releasing compounds described in U.S. Pat. No. 3,700,457 and JP-A-51-50725; the arylsulfonic acid described in JP-A-49-125016; the lithium salt of a carboxylic acid described in JP-A-51-47419; the oxidizing agents described in British Patent No. 1,455,271 and JP-A-50-101019; the sulfinic acids or thiosulfonic acids described in JP-A-53-19825; 2-thicuracils described in JP-A-51-3223; the elemental sulfur described in JP-A-51-26019; the disulfide and polysulfide compounds described in JP-A-51-42529, JP-A-51-81124 and JP-A-55-93149; the rosin or diterpenes described in JP-A-51-57435; polymeric acids having a free carboxylic or sulfonic acid group as described in JP-A-51-104338; the thiazolinethione described in U.S. Pat. No. 4,138,265; the 1,2,4-triazole or 5-mercapto-1,2,4-triazole described in JP-A-54-51821 and U.S. Pat. No. 4,137,079; the thiosulfinic acid esters described in JP-A-55-140833; the 1,2,3,4-thiatriazoles described in JP-A-55-142331; the dihalogen or trihalogen compounds described in JP-A-59-46641, JP-A-59-57233/1984 and JP-A-59-57234; the thiol compound described in JP-A-59-111636/1984; the hydroquinone derivative described in JP-A-60-198540; and the use of hydroquinone and benzotriazole derivatives as shown in JP-A-60-227255.

Other preferred antifoggants include the restrainer having a hydroxyl group that is described in JP-A-62-78554, the polymeric restrainer described in JP-A-62-121452, and the restrainer compound having a ballast group that is described in JP-A-62-123456.

The colorless coupler described in Japanese Patent Application No. 62-320599 may also be used with preference.

Illustrative base precursors include compounds that undergo decarboxylation upon heating to releases a basic substance (e.g., guanidium trichloroacetate) and compounds that are decomposed by reactions such as intramolecular nucleophilic substitution reaction to release amines. Examples of such base releasers are described in many prior patents such as JP-A-56-130745, JP-A-56-132332, British Patent No. 2,079,480, U.S. Pat. No. 4,060,420, JP-A-59-157637, JP-A-59-166943, JP-A-59-180537, JP-A-59-174830, JP-A-59-195237, JP-A-62-108249 and JP-A-62-174745.

Other additives that are used as required in heat-processible photographic materials may also be incorporated in the heat-processible photographic material of the present invention. Illustrative additives include antihalation dyes, brighteners, hardeners, antistats, plasticizers, extenders, matting agents, surface-active agents and antifading agents. Specific examples are given in Research Disclosure (RD), Vol. 170, No. 17029, June 1978, and JP-A-62-135825.

These additives may be incorporated not only into light-sensitive layers but also in to non-light-sensitive layers such as intermediate layers, protective layers and backing layers.

The heat-processible photographic material of the present invention contains (a) a light-sensitive silver halide, (b) a reducing agent, (c) a binder and (d) the dye-providing material of the present invention. Preferably, it further contains (e) an organic silver salt as required. In a basic mode, these components may be incorporated in one heat-processible light-sensitive layer but it should be noted that they are not necessarily incorporated in a single photographic constituent layer but may be incorporated in two or more constituent layers in such a way that they are held mutually reactive. In one instance, a heat-processible light-sensitive layer is divided into two sub-layers and components (a), (b), (c) and (e) are incorporated in one sub-layer with the dye-providing material (d) being incorporated in the other sub-layer which is adjacent to the first sub-layer.

If desired, the heat-processible light-sensitive layer may be divided into two or more layers including a highly sensitive layer and a less sensitive layer, or a high-density layer and a low-density layer.

The heat-processible photographic material of the present invention has one or more heat-processible light-sensitive layers on a base support. If it is to be used as a full-color light-sensitive material, the heat-processible photographic material of the invention generally has three heat-processible light-sensitive layers having different color sensitivities, each light-sensitive layer forming or releasing a dye of different color as a result of thermal development. A blue-sensitive layer is usually combined with a yellow dye, a green-sensitive layer with a magenta dye, and a red-sensitive layer with a cyan dye, but different combination may be used.

The choice of layer arrangements depends on the objective of a specific use. For instance, a base support is coated with a red-sensitive, a green-sensitive and a blue-sensitive layer, or in the reverse order (i.e., a blue-sensitive, a green-sensitive and a red-sensitive layer), or the support may be coated with a green-sensitive, a red-sensitive and a blue-sensitive layer.

Besides the heat-processible light-sensitive layers described above, the heat-processible photographic material of the present invention may incorporate non-light-sensitive layers such as a subbing layer, an intermediate layer, a protective layer, a filter layer, a backing layer and a release layer. The heat-processible light-sensitive layers and these non-light-sensitive layers may be applied to a base support by coating techniques that are similar to those commonly employed to coat and prepare ordinary silver halide photographic materials.

The heat-processible photographic material of the present invention is developed after imagewise exposure and this can usually be done by merely heating the material at a temperature in the range of 80°–200° C., preferably 100°–170° C., for a period of from 1–180 seconds, preferably 1.5–120 seconds. A diffusible dye may be transferred onto an image-receiving layer simultaneously with thermal development by bringing the image-receiving layer in the image-receiving member into intimate contact with the light-sensitive surface of the photographic material, alternatively, the photographic material brought into intimate contact with the image-receiving member after thermal development may be subsequently heated. In another method, water is supplied before the two members are brought into intimate contact with each other and the assembly is subsequently heated if desired. The photographic material may be preliminarily heated in the temperature range of 70°–180° C. prior to exposure. In order to enhance the adhesion between the photographic material and the image-receiving member, they may be separately heated at a temperature of 80°–250° C. just prior to thermal development and transfer, as described in JP-A-60-143338 and JP-A-61-162041.

The heat-processible photographic material of the present invention permits the use of a variety of known heating techniques.

All methods of heating that can be used with ordinary heat-processible photographic materials may be applied to the heat-processible photographic material of the present invention. In one instance, the photographic material may be brought into contact with a heated block or plate, or with heated rollers or a hot drum. Alternatively, the material may be passed through a hot atmosphere. High-frequency heating is also applicable. In still another method, an electroconductive layer containing a conductive material such as carbon black is provided either on the back side of the photographic material of the present invention or on the surface of an image-receiving member for heat-transfer and an electric current is applied to generate the Joule heat as heating energy. The heating pattern is in no way limited; preheating may be followed by another cycle of heating; heating may be performed for a short period at high temperatures or for a long period at low temperatures; the temperature may be elevated and lowered continuously; repeated cycles of heating may be employed; the heating may be discontinuous rather than continuous. In any event, a simple hating pattern is preferred. If desired, exposure and heating may proceed simultaneously.

Any image-receiving member may effectively be used in the present invention if the image-receiving layer employed has a capability for accepting the dye released or formed in the heat-processible light-sensitive layer as a result of thermal development. A preferred example is a polymer containing a tertiary amine or quaternary ammonium salt, as described in U.S. Pat. No. 3,709,690. Typical image-receiving layers suitable for use in diffusion transfer can be prepared by coating a base support, with a mixture in which a polymer containing an ammonium salt or tertiary amine is combined with gelatin or polyvinyl alcohol. Another useful dye-receiving layer may be formed of a heat-resistant organic high-molecular substance having a glass transition point of 40°–250° C. as described in JP-A-57-207250.

These polymers may be carried as image-receiving layers on a base support alternatively, they may be used as bases on their own.

Synthetic polymers having glass transition points of 40° C. and above as described in "polymer Handbook", 2nd ed., edited by J. Brandrup and E. H. Immergut, John Wiley & Sons are also useful. Useful molecular weights of these high-molecular substances are generally in the range of 2,000–200,000. These high-molecular substances may be used either independently or as blends. Two or more monomers may be employed to make copolymers.

Particularly preferred image-receiving layers include the polyvinyl chloride layer described in JP-A-59-223425 and the layer described in JP-A-60-19138 that comprises a polycarbonate and a plasticizer.

The polymers described above may be used as base supports that also serve as image-receiving layers to form image-receiving members.

In this case, the base support may be formed of a single layer or two or more layers.

Base supports for image-receiving members may be transparent or non-transparent. Illustrative supports include: films of polymers such as polyethylene terephthalate, polycarbonate, polystyrene, polyvinyl chloride, polyethylene and polypropylene; base supports having pigments such as titanium oxide, barium sulfate, calcium carbonate and talc incorporated in these plastic films; baryta paper; resin-coated (RC) paper having paper laminated with pigment-loaded thermoplastic resins; fabrics; glass; metals such as aluminum; base supports prepared by coating these materials with pigment-loaded electron beam curable resin compositions, followed by curing of the latter; and base supports having pigment-loaded coating layers on these materials. Also usable as a base support is the cast-coated paper described in JP-A-62-283333.

Particularly useful are the base support prepared by coating paper with a pigment-loaded electron-beam curable resin composition, followed by curing of the resin, and the base support prepared by applying a pigment coating layer to paper, which is then coated with an electron-beam curable resin composition, followed by curing of the resin. These base supports can immediately be used as image-receiving members since the resin layer itself serves as an image-receiving layer.

The heat-processible photographic material of the present invention may be of a "mono-sheet type" in which the light-sensitive layer and the image-receiving layer are formed on the same base support, as described in Research Disclosure (RD) No. 15108, and JP-A-57-198458, JP-A-57-207250 and JP-A-061-80148.

The heat-processible photographic material of the present invention is preferably provided which a protective layer.

The protective layer may contain a variety of additives that are commonly employed in the photographic industry. Suitable additives include matting agents, colloidal silica, slip agents, organofluoro compounds (in particular, fluorine-based surface active agents), antistats, uv absorbers, high-boiling organic solvents, antioxidants, hydroquinone derivatives, polymer latices, surface-active agents (including high-molecular surface-active agents), hardeners (including high-molecular hardeners), particulate organic silver salts, non-light-sensitive silver halide grains, antistats, development accelerators, etc.

For details of these additives, reference should be made to Research Disclosure, Vol. 170, No. 17029, June 6, 1978, and JP-A-62-135825.

The following examples are provided for the purpose of further illustrating the present invention but are in no way to be taken as limiting.

EXAMPLE 1

Silver iodobromide emulsions, dispersions of an organic silver salt and a thermal solvent, a dispersion of dye-providing materials and a dispersion of reducing agents were prepared by the procedures described below. In Example 1, sample No. 1 of photographic material was prepared using those emulsions and dispersions. An image-receiving member was also prepared. Unless otherwise noted, the amounts of components added are expressed in terms of values per square meter of the photographic material or image-receiving member (the same applies to Table 2 to be given below).

(1) Preparation of silver iodobromide emulsion:

To solution (A) having ossein gelatin (20 g) and ammonia dissolved in distilled water (1,000 ml), 500 ml of aqueous solution (B) containing 11.6 g of potassium iodide and 131 g of potassium bromide and 500 ml of aqueous solution (C) containing 1 mole of silver nitrate and ammonia were added simultaneously, with the pAg being controlled to be constant, at 50° C. using a mixer/stirrer of the type described in JP-A-57-92523 and JP-A-57-92524. The shape and size of the grains in the emulsion being prepared were adjusted by controlling the pH, pAg and the rates at which solutions (B) and (C) were added. In this way, a core emulsion comprising octahedral grains with 7 mol % AgI and an average size of 0.25 μm was prepared. By repeating the above procedures, the core grains were coated with a silver halide shell having 1 mol % AgI, so as to prepare a core/shell type silver halide emulsion comprising octahedral grains with an average size of 0.3 μm. These grains had a monodispersity of 9%. The so prepared emulsion was washed with water and desalted.

(2) Preparation of silver halide dispersions:

To 700 ml of the AgIBr emulsion prepared in (1), the components shown below were added and chemical sensitization, spectral sensitization and other necessary treatments were conducted to prepare dispersions of red-, green- and blue-sensitive silver halide emulsions.

| | | |
|---|---|---|
| (a) | Preparation of red-sensitive AgIBr emulsion | 700 ml |
| | AgIBr emulsion prepared in (1) | |
| | 4-Hydroxy-6-methyl-1,3,3a,7-tetrazaindene | 0.4 g |
| | Gelatin | 32 g |
| | Sodium thiosulfate | 10 mg |
| | Sensitizing dye (a) (1% MeOH sol.) | 80 ml |
| | Distilled water | 1200 ml |

Sensitizing dye (a)

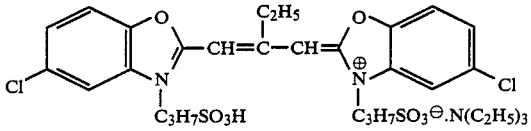

| | | |
|---|---|---|
| (b) | Preparation of green-sensitive AgIBr emulsion | 700 ml |
| | AgIBr emulsion prepared in (1) | |
| | 4-Hydroxy-6-methyl-1,3,3a,7-tetrazaindene | 0.4 g |
| | Gelatin | 32 g |
| | Sodium thiosulfate | 10 mg |
| | Sensitizing dye (b) (1% MeOH sol.) | 80 ml |
| | Distilled water | 1200 ml |

Sensitizing dye (b)

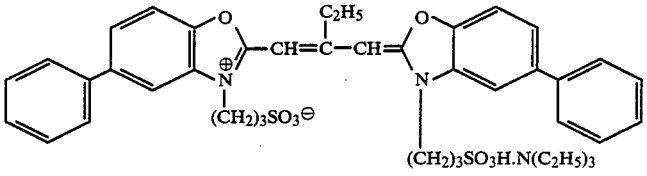

| | | |
|---|---|---|
| (c) | Preparation of blue-sensitive AgIBr emulsion | 700 ml |
| | AgIBr emulsion prepared in (1) | |
| | 4-Hydroxy-6-methyl-1,3,3a,7-tetrazaindene | 0.4 g |
| | Gelatin | 32 g |
| | Sodium thiosulfate | 10 mg |
| | Sensitizing dye (c) (1% MeOH sol.) | 80 ml |
| | Distilled water | 1200 ml |

-continued

Sensitizing dye (c)

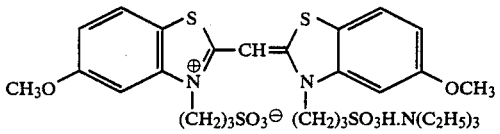

| | | |
|---|---|---|
| (d) | Preparation of infrared-sensitive AgIBr emulsion | 700 ml |
| | AgIBr emulsion prepared in (1) | |
| | 4-Hydroxy-6-methyl-1,3,3a,7-tetrazaindene | 0.6 g |
| | Sensitizing dye (d) (0.1% MeOH sol.) | 80 ml |
| | Sensitizing dye (e) (0.05% MeOH sol.) | 40 ml |
| | Sodium thiosulfate | 20 mg |
| | Ion exchanged water | 1200 ml |

Sensitizing dye (d)

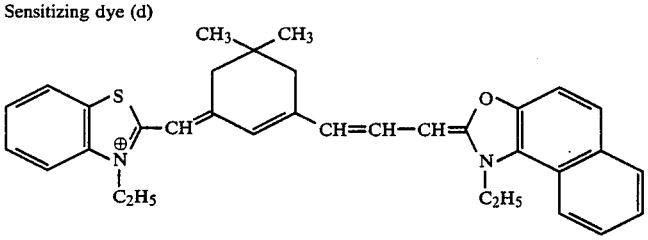

Sensitizing dye (e)

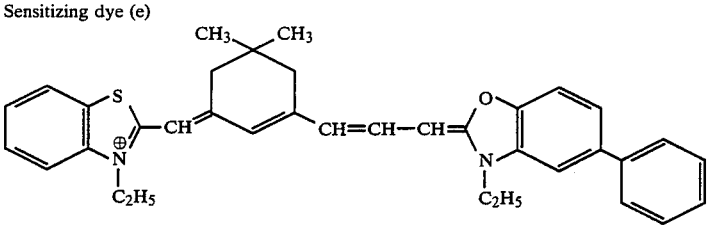

(3) Preparation of a dispersion of organic silver salt:

5-Methyl benzotriazole was reacted with silver nitrate in a mixed solvent of water and alcohol to form 5-methyl benzotriazole. A portion (28.8 g) of this compound was mixed with 16.0 g of poly (N-vinylpyrrolidone) and 0.65 g of 5-methylbenzotriazole in an alumina ball mill to form a dispersion. The pH of this dispersion was adjusted to 6.0 and its volume to 200 ml.

(4) Preparation of a dispersion of thermal solvent:

Twenty-five grams of thermal solvent (1) shown below was dispersed in 100 ml of 0.5% aqueous polyvinylpyrrolidone in an alumina ball mill and its volume was adjusted to 120 ml.

Thermal solvent (1)

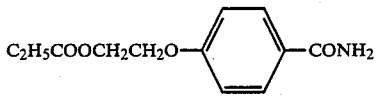

(5) Preparation of a dispersion of thermal solvent and organic silver salt:

Twenty-five grams of thermal solvent (2) (p-methylbenzamide), 6.3 g of 5-methylbenzotriazole silver and 0.3 g or 5-methylbenzotriazole were dispersed in 130 ml of 1% aqueous polyvinylpyrrolidone in an alumina ball mill and the volume of the resulting dispersion was adjusted to 150 ml.

(6) Preparation of dye-providing material dispersion 1:

Twenty (20.0) grams of dye-providing material (C-1) which was within the scope of the present invention, 0.5 g of compound (ST-1) shown below and 1.2 g of (SC-1) also shown below were dissolved in 100 ml of ethyl acetate and 15 ml of di-(2-ethylhexyl)phthalate. The resulting solution was mixed with 124 ml of a 5 wt % aqueous solution of Alkanol XC (Du Pont) and 720 ml of an aqueous gelatin solution containing 30.5 g of phenylcarbamoylated gelatin (Lousreau). The mixture was treated with an ultrasonic homogenizer to make a dispersion. After distilling off the ethyl acetate, the pH of the dispersion was adjusted to 6.0 and its volume to 795 ml, thereby making dye-providing material dispersion 1.

ST-1

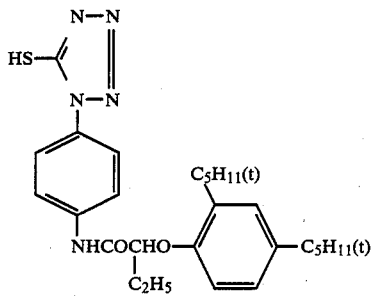

-continued

SC-1

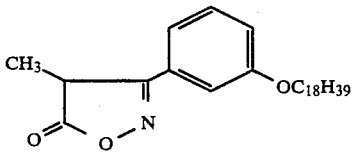

(7) Preparation of a solution of reducing agents:

Twenty (20.0 g) grams of reducing agent 1 (see below), 3.3 g of reducing agent 2 (see below) and 0.50 g of fluorine-based surfactant 1 (see below) were dissolved in water and pH adjusted to 6.0 to make a solution of reducing agents in a volume of 250 ml.

Reducing agent 1

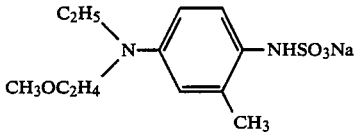

Reducing agent 2

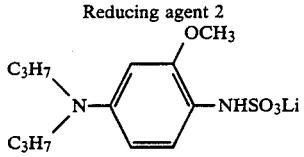

Surfactant 1

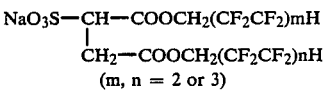

(m, n = 2 or 3)

(8) Preparation of photographic material:

Using the thus prepared dispersions of organic silver salts, red-sensitive silver halide emulsion, dispersion of dye-providing material and solution of reducing agents, a color photographic material was prepared in the following way. To a latex-subbed transparent poly-ethylene terephthalate base support 180 μm thick, a coating solution was applied to have the respective components deposited in the following amounts: 5-methylbenzotriazole silver 0.5 g/m$^2$; dye-providing material, 0.5 g/m$^2$; reducing agents, 0.35 g/m$^2$; red-sensitive silver halide, 0.81 g (Ag)/m$^2$; thermal solvents, 4.0 g/m$^2$; gelatin, 2.0 g/m$^2$; phenylcarbamoylated gelatin, 0.5 g/m$^2$; and polyvinylpyrrolidone (K-30), 0.5 g/m$^2$. The thus prepared photographic material was designated No. 1.

(9) Preparation of image-receiving member:

A polyvinyl chloride layer (image-receiving layer) containing compounds (TP-1) and (AC-1) was coated onto photographic baryta paper to make an image-receiving member.

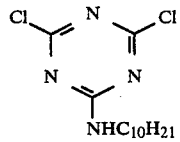

(TP-1)

0.8 g/m$^2$ $HOCH_2CH_2SCH_2CH_2SCH_2CH_2OH$ 0.2 g/m$^2$ (AC-1)

The photographic material No. 1 was exposed to red light through a step wedge. The image-receiving member was superposed on the exposed photographic material and the assembly was subjected to thermal development at 40° C. for 70 seconds.

The density of the yellow image formed was measured with a reflection densitometer (DDA-65 of Konica Corp.) and the maximum density (Dmax) and minimum density (Dmin) obtained are shown in Table 1, from which one can see that the image had a satisfactorily high density and low fog in spite of the fact that the silver content and the amounts of reducing agents and dye-providing material were reduced.

EXAMPLE 2

Additional photographic materials (Nos. 2–12) were prepared as in Example 1 except that the dye-providing material (C-1) and silver halide were changed to those listed in Table 1 (for the structural formulas of the comparative dye-providing materials, see below). The dye-providing materials were added in the same molar amount as in Example 1, and the silver halides were added in the same weight as in Example 1. The prepared photographic materials were processed as in Example 1, except that the exposing light had a wave-length suitable for the color sensitivity of the silver halide used. The results are shown in Table 1. Photographic sample No. 12 was identical to sample No. 9 except that the deposited amounts of all components were doubled.

TABLE 1

| Sample No. | | Dey-providing material | Silver halide | Dmax | Dmin |
|---|---|---|---|---|---|
| Samples of the invention | 1 | C-1 | red-sensitive silver halide | 2.01 | 0.12 |
| | 2 | C-5 | red-sensitive silver halide | 2.53 | 0.15 |
| | 3 | C-12 | green-sensitive silver halide | 2.34 | 0.07 |
| | 4 | C-14 | red-sensitive silver halide | 2.04 | 0.12 |
| | 5 | C-15 | red-sensitive silver halide | 2.01 | 0.11 |
| | 6 | C-17 | red-sensitive silver halide | 2.57 | 0.16 |
| | 7 | C-18 | red-sensitive silver halide | 2.51 | 0.14 |
| | 8 | C-23 | green-sensitive silver halide | 2.29 | 0.08 |
| Comparison | 9 | A | red-sensitive silver halide | 1.08 | 0.11 |
| | 10 | B | red-sensitive silver halide | 1.43 | 0.14 |
| | 11 | C | red-sensitive silver halide | 1.17 | 0.07 |
| | 12 | A | red-sensitive silver halide | 1.91 | 0.25 |

The structures of the comparative dye-providing materials are shown below:

Coupler A

-continued

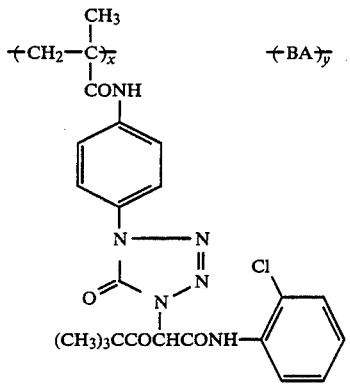

x: 70 wt %
y: 30 wt %

Coupler B

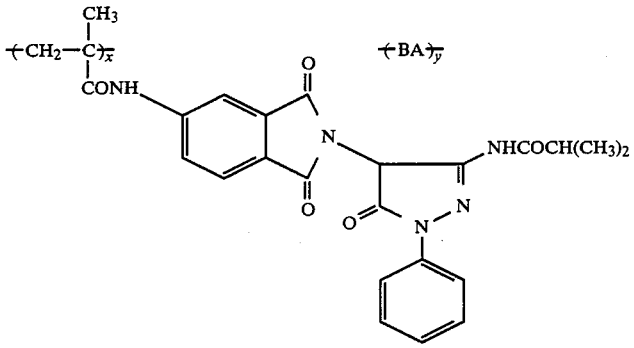

x: 60 wt %
y: 40 wt %

Coupler C

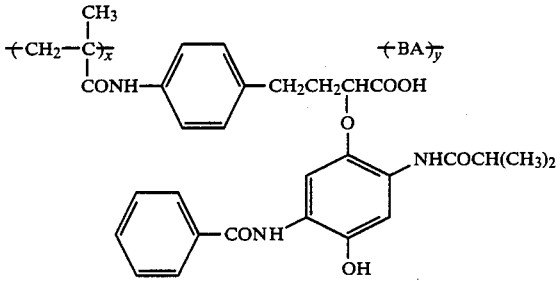

x: 50 wt %
y: 50 wt %

As one can see from Table 1, photographic sample Nos. 2–8 prepared in accordance with the present invention were comparable to sample No. 1 in that the images they produced had high maximum densities and low degrees of fogging. Further, the silver content and the amounts of reducing agents and dye-providing materials could be reduced. On the other hand, sample Nos. 9–11 were incapable of providing satisfactory maximum density. In order to attain satisfactory maximum density, the deposited amounts of all components had to be increased as in comparative sample No. 12 so that the silver content and the amounts of reducing agents and dye-providing material were increased. This was effective in providing a higher maximum density but at the same time, extensive fogging occurred.

EXAMPLE 3

A multi-layered photographic material (No. 13) having the layer arrangement and compositions shown in Table 2 was prepared. Layers 1 and 2 were first coated simultaneously on a base support and after drying those layers, four additional layers (3–6) were coated simultaneously. Each of the six layers contained surfactant 2 (see below) as a coating aid. The product of reaction between tetraquis (vinylsulfonylmethyl)methane and K salt of taurine (reacted at a molar ratio of 1:0.75) was also incorporated in each of the layers as a hardener.

Surfactant 2

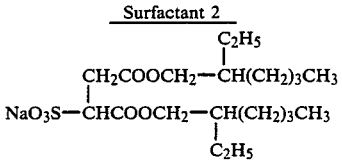

The so prepared photographic sample No. 13 was exposed to blue, green and red light through step wedges. After superposing the image-receiving member described in Example 1, the photographic material was subjected to thermal development as in Example 1. The maximum densities (Dmax) and minimum densities (Dmin) of the yellow, magenta and cyan color images thus obtained are shown in Table 3, from which one can see that images of high maximum densities and low minimum densities could be produced in accordance with the present invention using a lower silver content and smaller amounts of reducing agents and dye-providing materials.

TABLE 2

| | | |
|---|---|---|
| Layer 6 | protective layer | gelatin, 0.6 g; silica powder, 0.20 g; thermal solvent (1), 0.75 g; SC-1, 0.20 g |
| Layer 5 | blue-sensitive layer | 5-methylbenzotriazole silver, 0.82 g; reducing agent, 0.97 g; coupler C, 1.2 g; blue-sensitive silver halide emulsion, 0.46 g (Ag); gelatin, 2.0 g; phenylcarbamoylated gelatin, 1.0 g; polyvinylpyrrolidone (K-30), 0.84 g; thermal solvent (1), 4.0 g; 5-methylbenzotriazole, 0.02 g; sodium chloride, 0.002 g; ST-1, 0.005 g; SC-1, 0.07 g |
| Layer 4 | second intermediate layer | gelatin, 0.75 g; phenylcarbamoylated gelatin, 0.25 g; polyvinylpyrrolidone (K-30), 0.25 g; filter dye (F-1), 0.40 g; reducing agent, 0.6 g |
| Layer 3 | green-sensitive layer | 5-methylbenzotriazole silver, 0.28 g; reducing agent, 0.38 g; dye-providing material C-18, 0.60 g; anti-irradiation dye (AIM-1), 0.02 g; green-sensitive silver halide emulsion, 0.18 g (Ag); gelatin, 1.5 g; phenylcarbamoylated gelatin, 0.5 g; polyvinylpyrrolidone (K-30), 0.50 g; thermal solvent (1), 3.0 g; 5-methylbenzotriazole, 0.02 g; sodium chloride, 0.002 g; ST-1, 0.005 g |
| Layer 2 | first intermediate layer | gelatin, 1.0 g; reducing agent, 0.28 g |
| Layer 1 | red-sensitive layer | 5-methylbenzotriazole silver, 0.21 g; reducing agent, 0.38 g; dye-providing material C-14, 0.4 g; red-sensitive silver halide emulsion, 0.41 g; gelatin, 1.0 g; phenylcarbamoylated gelatin, 1.0 g; polyvinylpyrrolidone (K-30), 0.66 g; thermal solvent (1), 3.90 g; 5-methylbenzotriazole, 0.02 g; sodium chloride, 0.002 g; ST-1, 0.005 g |
| | Base support | latex-subbed, transparent polyethylene terephthalate film with a thickness of 180 μm |

Note:
The indicated amounts of respective components are deposits per square meter, except that the amounts of silver halides are calculated in terms of silver deposit.

Filter dye F-1

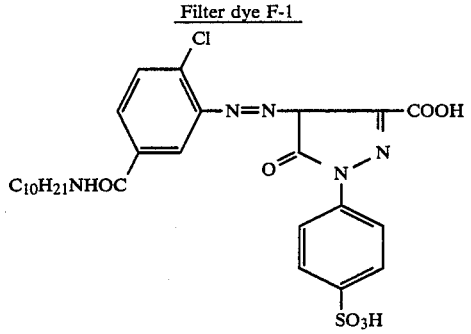

Anti-irradiation dye AIM-1

-continued

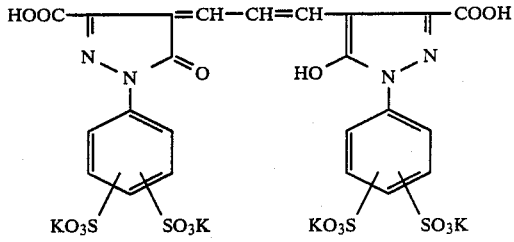

TABLE 3

| Dye image | Dmax | Dmin |
|---|---|---|
| Yellow (Y) | 1.93 | 0.09 |
| Magenta (M) | 2.21 | 0.07 |
| Cyan (C) | 2.01 | 0.05 |

EXAMPLE 4

Photographic material No. 14 was prepared as in Example 3 except that layers 1, 3 and 5 in sample No. 13 were changed to those described below. Comparative sample No. 15 was also prepared as in Example 3 except that the dye-providing materials in layers 1 to 3 of sample No. 13 were changed to those described below.

| Sample No. 14 | | |
|---|---|---|
| Layer 1: | (1) | The red-sensitive halide emulsion (Ag deposit, 0.41 g) was changed to an infrared-sensitive silver halide emulsion that was coated to give a silver deposit of 0.35 g. |
| | (2) | Instead of C-14, 0.5 g of C-23 was used as a dye-providing material. |
| Layer 3: | | Instead of the green-sensitive silver halide emulsion, a red-sensitive silver halide emulsion was coated to give a silver deposit of 0.28 g. |
| Layer 5: | (1) | The amount of 5-methylbenzotriazole silver was changed from 0.82 g to 0.28 g. |
| | (2) | The amount of reducing agents was changed from 0.97 g to 0.4 g. |
| | (3) | Instead of coupler C, dye-providing material C-14 was used in an amount of 0.4 g. |
| | (4) | Instead of the blue-sensitive silver halide emulsion, a green-sensitive silver halide emulsion was coated to give a silver deposit of 0.28 g. |

Sample No. 15

Layer 1: Dye-providing material C-14 was replaced by 0.4 g of coupler A.

Layer, 3: Dye-providing material C-18 was replaced by 0.6 g of coupler B.

Photographic sample No. 15 was exposed as in Example 3 whereas sample No. 14 was exposed to green, red and infrared light through step wedges. After an image-receiving member was superposed, both samples were subjected to thermal development as in Example 3 and the densities of the color images obtained were measured. The results are shown in Table 4, from which one can see that sample No. 14 prepared in accordance with the present invention attained a satisfactorily high maximum density without experiencing any increase in fogging.

TABLE 4

| Sample No. | Color image | Dmax | Dmin |
|---|---|---|---|
| 14 (sample of the invention) | yellow (Y) | 2.10 | 0.10 |
| | magenta (M) | 2.24 | 0.07 |

TABLE 4-continued

| Sample No. | Color image | Dmax | Dmin |
|---|---|---|---|
| | cyan (C) | 2.00 | 0.05 |
| 15 (comparison) | yellow (Y) | 1.09 | 0.08 |
| | magenta (M) | 1.29 | 0.08 |
| | cyan (C) | 2.99 | 0.06 |

As will be apparent from the foregoing description, the heat-processible color photographic material of the present invention is capable of forming a high-density, low-fog image in spite of low silver content and reduced use of reducing agents and dye-providing materials.

What is claimed is:

1. A heat-processible color photographic material having on a base support at least a light-sensitive silver halide, a reducing agent, a binder and a dye-providing material represented by the following general formula (1):

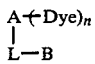

(1)

where A is a coupler site capable of dye formation by entering into a coupling reaction with the oxidized product of the reducing agent; L is a divalent linkage group binding to A at the active point of the coupler site represented by A; B is a ballast group having a sufficient molecular size or shape to render the dye-providing material of the general formula (1) substantially immobile during thermal development; Dye is a dye site; n is 1, 2 or 3, part of the coupler site A optionally serving as part of the dye site Dye.

2. A heat-processible color photographic material according to claim 1 wherein the coupler site denoted by A in the general formula (1) is selected from among those represented by the following general formula (2) to (11):

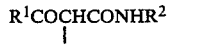

(2)

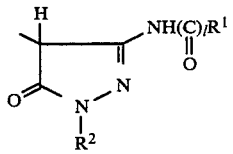

(3)

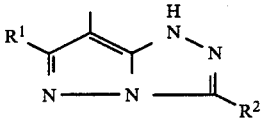

(4)

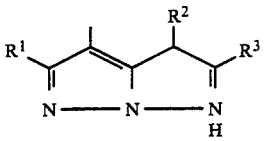

(5)

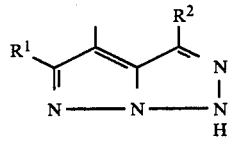

(6)

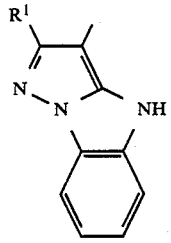

(7)

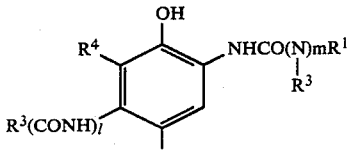

(8)

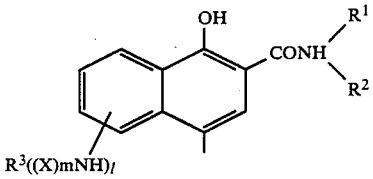

(9)

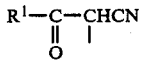

(10)

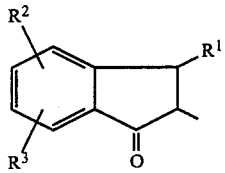

(11)

where $R^1$, $R^2$ and $R^3$ each represents an alkyl group, an aryl group or a hydrogen atom, which alkyl or aryl group may have a substituent, provided that at least one of $R^1$ and $R^2$ is substituted by the dye site (Dye) or serves as part of the dye site; e is 0 or 1: m is 0 or 1; and X is CO or $SO_2$.

3. A heat-processible color photographic material according to claim 1 wherein the divalent linkage group represented by L in the general formula (1) is exemplified by the following groups:

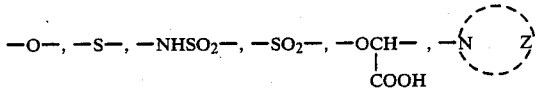

(Z is a collection of atoms that form the nitrogenous hetero ring and it preferably has a carbonyl group adjacent the binding site of the active point of the coupler site).

4. A heat-processible color photographic material according to claim 1 wherein the ballast group represented by B in the general formula (1) is an organic group having at least 8 carbon atoms or a polymer residue.

5. A heat-processible color photographic material according to claim 1 wherein B is a polymeric residue, the dye-providing material represented by the general formula (1) is a polymer derived from a monomer represented by the following general formula (12):

$$\begin{array}{l} A\text{-}(Dye)_n \\ | \\ L\text{-}(R^5)_{p1}\text{-}(J^1)_{q1}\text{-}(R^6)_{p2}\text{-}(J^2)_{q2}\text{-}C{=}CH_2 \\ \qquad\qquad\qquad\qquad\qquad\qquad\quad | \\ \qquad\qquad\qquad\qquad\qquad\qquad\quad R^7 \end{array} \tag{12}$$

where A, L, n and Dye each has the same meaning as defined in the general formula (1); $R^5$ and $R^6$ are each a divalent hydrocarbon group; $J^1$ and $J^2$ are each a divalent linkage group; $P_1$, $P_2$, $q_1$ and $q_2$ are each an integer of 0 or 1; and $R^7$ is a hydrogen atom or an alkyl group.

6. A heat-processible color photographic material according to claim 1 wherein the dye site represented by Dye in the general formula (1) is selected from among an azo dye, an azomethine dye, an anthraquinone dye, a naphthoquinone dye, a styryl dye, a nitro dye, a quinoline dye, a carbonyl dye and a phthalocyanine dye.

7. A heat-processible color photographic material according to claim 1 wherein the dye site represented by Dye in the general formula (1) has a molecular weight of no more than 600.

8. A heat-processible color photographic material according to claim 1 wherein said dye-providing material is used in an amount of 0.005–50 g per square meter.

9. A heat-processible color photographic material according to claim 1 which further contains an organic silver salt.

10. A heat-processible color photographic material according to claim 1 which is of a transfer type using an image-receiving member.

11. A heat-processible color photographic material according to claim 10 wherein a thermal solvent is contained in said photographic material and/or said image-receiving member.

12. A heat-processible color photographic material according to claim 1 which is to be developed by heating at 80°–200° C. for 1–180 seconds subsequent to imagewise exposure.

* * * * *